US011473235B1

(12) United States Patent
Freeman

(10) Patent No.: US 11,473,235 B1
(45) Date of Patent: Oct. 18, 2022

(54) IRONING BOARD WITH A STORAGE TRAY

(71) Applicant: Duden V. Freeman, Roswell, GA (US)

(72) Inventor: Duden V. Freeman, Roswell, GA (US)

(73) Assignee: IP Assets LLC, Alpharetta, GA (US)

( * ) Notice: Subject to any disclaimer, the term of this patent is extended or adjusted under 35 U.S.C. 154(b) by 0 days.

(21) Appl. No.: 17/670,289

(22) Filed: Feb. 11, 2022

Related U.S. Application Data

(60) Provisional application No. 63/276,287, filed on Nov. 5, 2021.

(51) Int. Cl.
*D06F 81/02* (2006.01)

(52) U.S. Cl.
CPC ..... *D06F 81/02* (2013.01)

(58) Field of Classification Search
CPC ..... D06F 81/02; D06F 81/00; D06F 81/003; D06F 81/006; D06F 81/12; D06F 79/00; D06F 79/02
USPC ..... D32/66, 73
See application file for complete search history.

(56) References Cited

U.S. PATENT DOCUMENTS 3,055,129 A * 9/1962 Selleck ..... D06F 81/00 38/142
3,904,041 A * 9/1975 Medgebow ..... A47G 23/0641 248/315
4,154,010 A * 5/1979 Evans ..... D06F 81/00 248/311.2
D293,842 S * 1/1988 Titi ..... D06F 79/02 D32/73
7,080,416 B1 * 7/2006 Portnell ..... A47K 3/001 211/119.011
8,132,346 B1 * 3/2012 Cooper ..... D06F 79/02 248/117.7
8,250,789 B1 * 8/2012 Oliver ..... D06F 81/02 38/135
2012/0060397 A1 * 3/2012 Danzyger ..... D06F 81/003 38/107
2013/0312297 A1 * 11/2013 Ducruet ..... D06F 81/02 38/103

* cited by examiner

*Primary Examiner* — Ismael Izaguirre
(74) *Attorney, Agent, or Firm* — Barry Choobin; Patent 360

(57) ABSTRACT

A tray for an ironing board to store small articles during an ironing process. The ironing board has two stands, one stand of the two stands has two legs, wherein the two stands can be folded for storage and unfolded for use. The tray includes a tray body, the tray body has three spaced apart compartments, wherein spacings between two adjacent compartments of the three compartments are larger than the width or diameter of the two legs, wherein the tray is configured to be mounted to the ironing board, such that the two legs are received in the spacings between the three compartments when the two stands are folded. The tray can be fastened to an iron tray of the ironing board.

20 Claims, 6 Drawing Sheets

IRONING BOARD WITH A STORAGE TRAY

CROSS-REFERENCE TO RELATED APPLICATIONS

This application claims priority from the U.S. provisional patent application Ser. No. 63/276,287, filed on Nov. 5, 2021, which is incorporated herein by reference in its entirety.

FIELD OF INVENTION

The present invention relates to ironing boards and, more particularly, the present invention relates to a storage accessory for an ironing board and a foldable ironing board with the storage accessory mounted thereon.

BACKGROUND

Ironing boards have been popular domestic appliances for a long time. Ironing boards are commercially available mostly in a compact design having an elongated board with long-standing pivoting legs that can be folded to collapse the ironing board for storage. In most ironing boards commercially available, the board has a broader side and an opposite narrower side. Adjacent to the broader side is mounted an iron tray that can be used to put the hot iron during the ironing process.

Often a need arises for storing small articles during the ironing process and a person ironing their clothes generally places these articles on the board, however, such articles can be damaged by the hot iron. Pockets and pouches that can be hung from a bar of the ironing board are known in the art that can be used to store small size articles, such as buttons, starch, and other sprays used for ironing, sewing pins, and other items such as cell phones and television remote control devices. However, the use of such hangable pouches or pockets is generally uncomfortable requiring the person to bend for accessing the pouch, and the pouches or pockets are often made of fabric making them unstable. Thus, a need is appreciated for a storage accessory for an ironing board that is convenient to use and stable. A need is appreciated for an ironing board with a storage accessory that is readily accessible for storing small-size articles.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a storage tray for an ironing board.

It is another object of the present invention that the storage tray is readily accessible while ironing.

It is still another object of the present invention that the storage tray can be firmly and stably mounted.

It is yet another object of the present invention that the storage tray does not interfere with the folding mechanism of the ironing board.

It is a further object of the present invention that the storage tray is economical to manufacture.

It is still a further object of the present invention that the storage tray can be easily fastened to the ironing board.

It is an additional object of the present invention that the storage tray need not be dismounted for folding the ironing board.

It is still an additional object of the present invention that the storage tray provides good storage space without significantly increasing the size of the ironing board.

In one aspect, disclosed is a tray for an ironing board, the ironing board has two stands, one stand of the two stands has two legs, the storage tray comprises a tray body, the tray body has three spaced apart compartments, a first compartment, a second compartment, and a third compartment, wherein spacings between two adjacent compartments of the three compartments are more than a width or diameter of the two legs, wherein the tray is configured to be mounted to the ironing board, such that the two legs are received in the spacings between the three compartments when the stands are folded.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
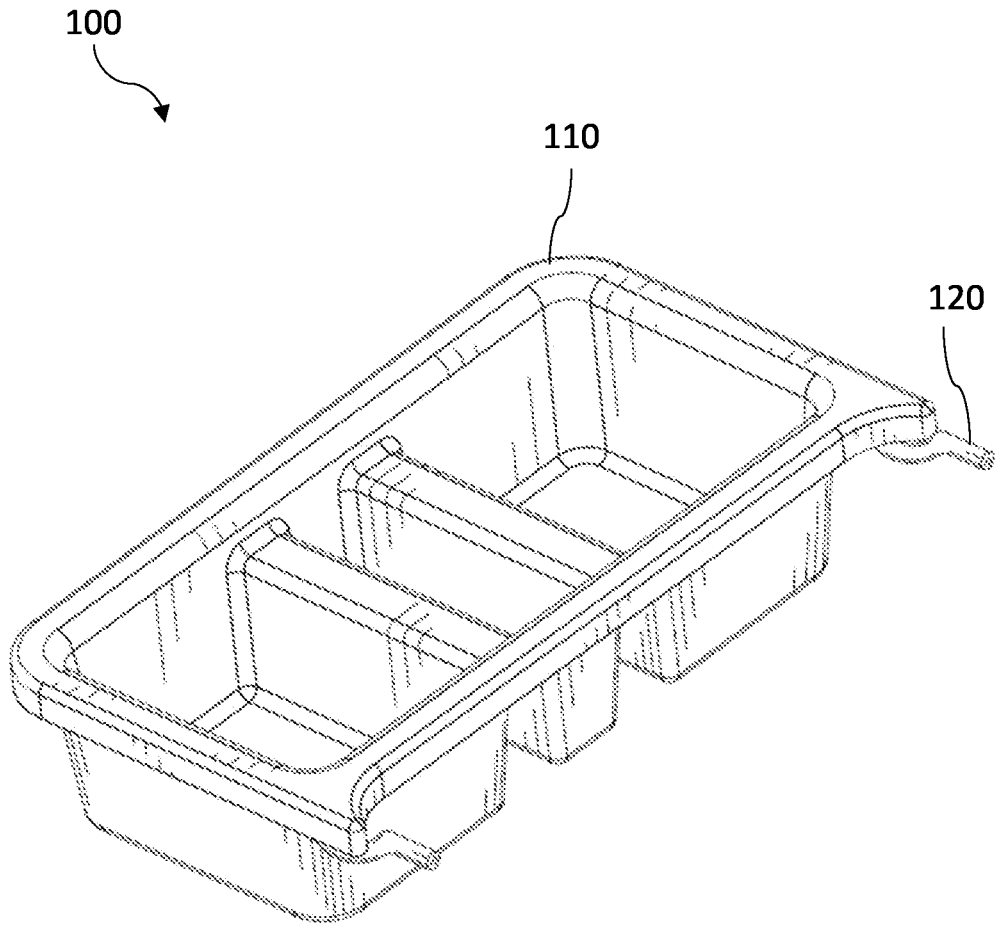
FIG. 1 is a perspective view of a storage tray for an ironing board, according to an exemplary embodiment of the present invention.
Figure 2:
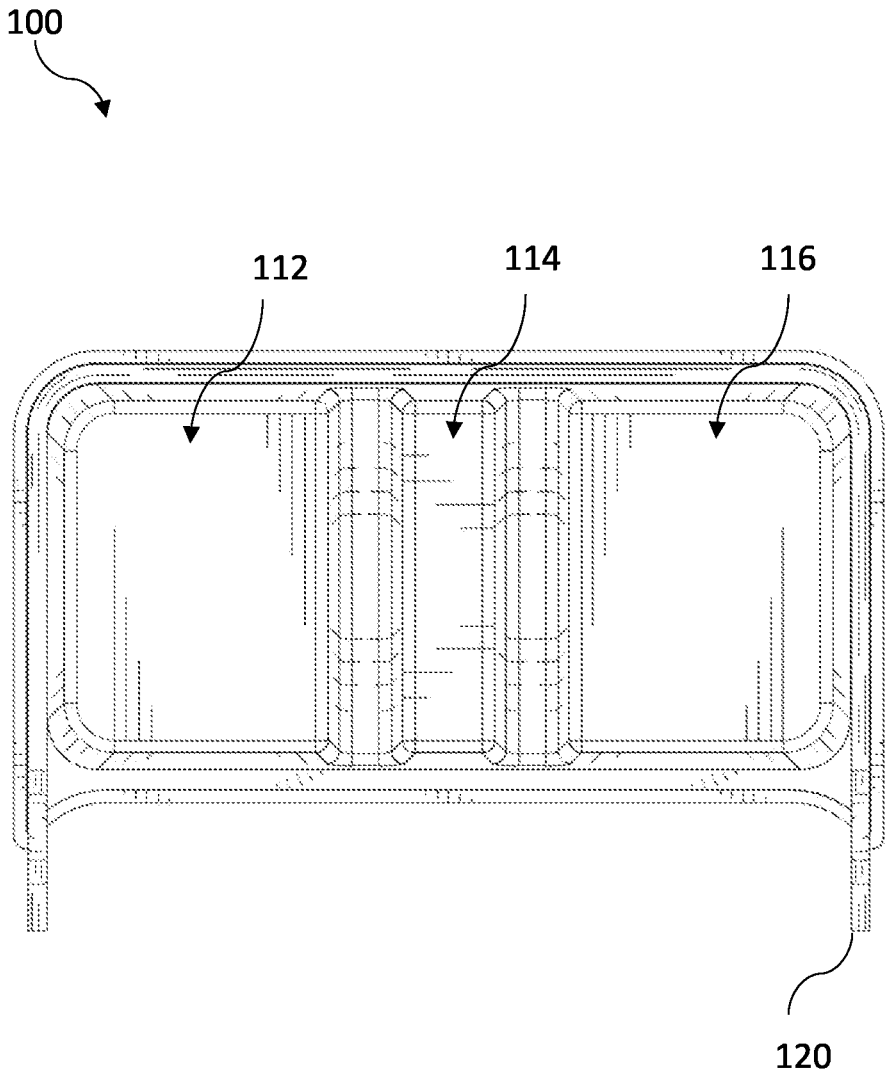
FIG. 2 is a top view of the storage tray showing three compartments, according to an exemplary embodiment of the present invention.
Figure 3:
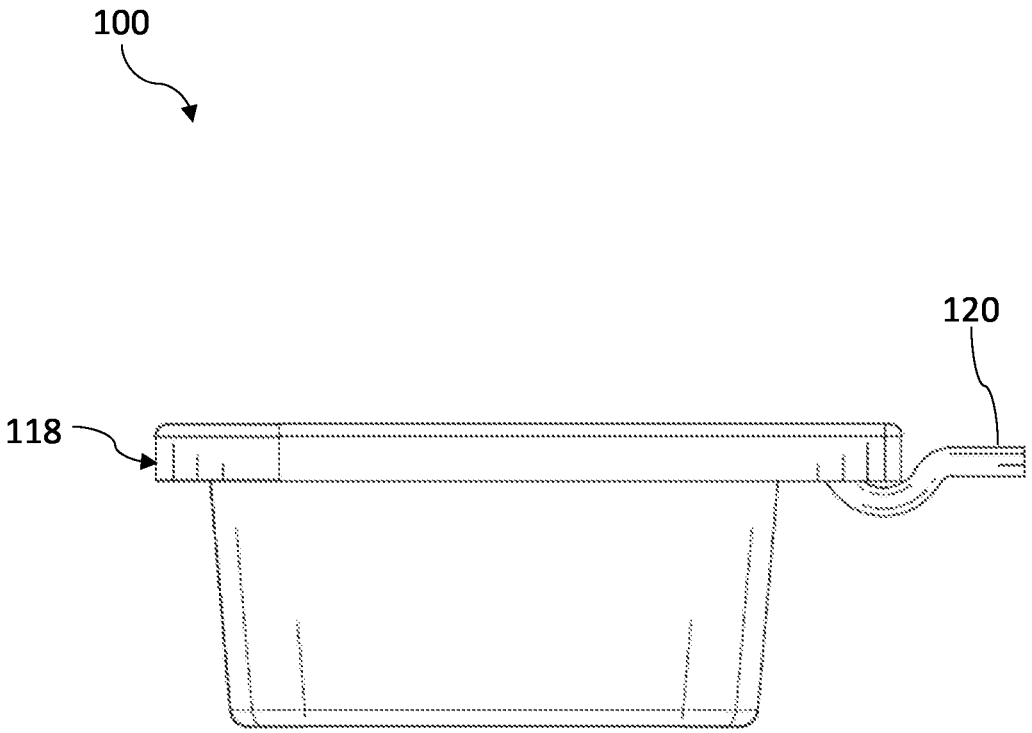
FIG. 3 is a side view of the storage tray showing the support rod or rail, according to an exemplary embodiment of the present invention.
Figure 4:
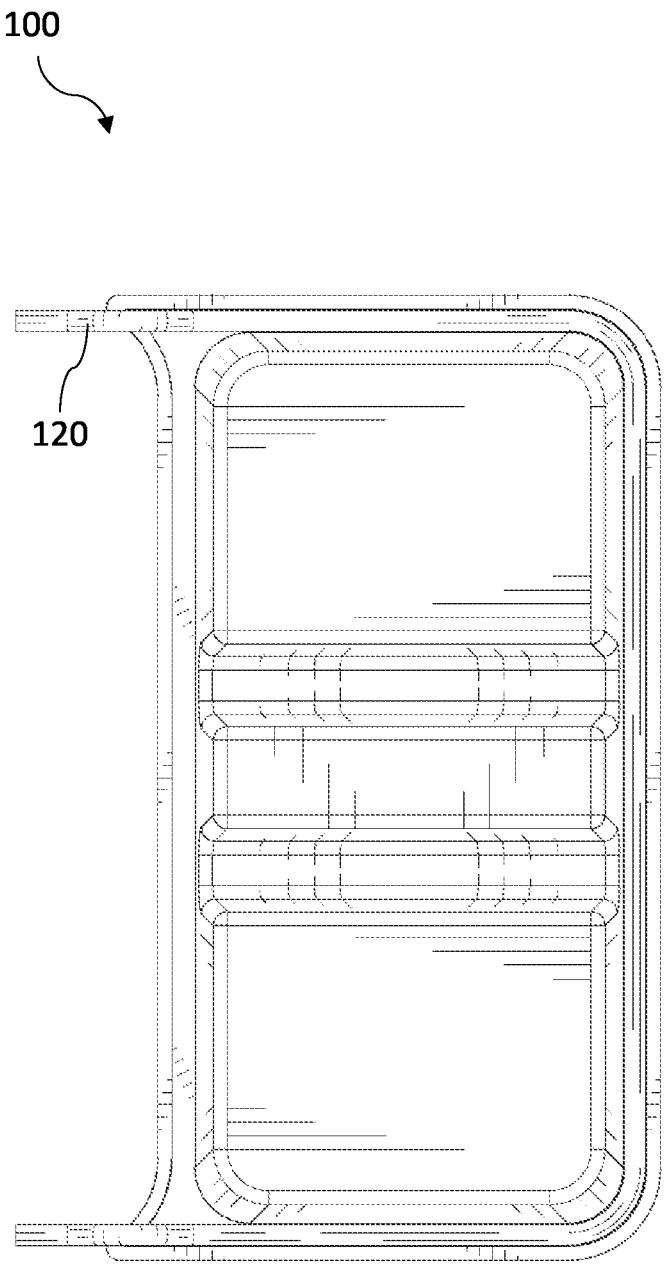
FIG. 4 is a bottom view of the storage tray showing the rail running along three sides of the tray, according to an exemplary embodiment of the present invention.

Disclosed is a storage tray for an ironing board that is readily accessible for storing small size articles, such as the buttons, starch, and other sprays used in ironing, sewing pins, and other items such as cell phones and television remote control devices. Also, disclosed is an ironing board with a storage tray. The tray is firmly installed on a side of an iron tray or a plate used for placing a hot iron while ironing. The disclosed tray does not interfere with the folding and unfolding of the ironing board. Referring to FIGS. 1-4, wherein FIG. 1 shows the perspective view, FIG. 2 shows a top view, FIG. 3 shows a side view, and FIG. 4 shows a bottom view of the storage tray 100. The storage tray 100 has a tray body 110 that can have three compartments in which small size articles can be stored in an organized manner. The articles needed during the ironing process can be readily kept in a suitable compartment of the tray. The storage tray can be readily accessible during the ironing process without the need for a person to bend to reach the tray. FIG. 2 shows three compartments i.e., first compartment 112, a second compartment 114, and a third compartment 116. The first compartment 112 and the third compartment 116 are shown of the same size and bigger than the middle second compartment 114. It is understood that the size and shape of the three compartments of the storage tray 100 can vary without departing from the scope of the present invention. The storage tray can be manufactured from a durable material, such as plastic or metal sheet. However, any other type of material, such as silicone is within the scope of the present invention. Moreover, the storage tray can be large enough to store multiple small sized articles and at the same time the storage tray may not interfere with the closing and opening mechanism of the ironing board.

A rail 120, also referred to herein as the support rod can mount the storage tray 100 to a frame of the ironing board. The rail 120 can be of a rod-like configuration that can wrap around the tray body 110 on three sides i.e., a front side, a left side, and a right side, and the two ends of the rail can extend from the left side and the right side of the tray body 110 away from the rear side. This extended portion of the rail can be fastened to the frame of the ironing board, as shown in FIG. 4 which is a bottom view of the storage tray 100, the rail 120 can be seen running along the three sides of the tray body 110. Again, referring to FIG. 3, the tray body 110 has a flange 118 along a top periphery and the flange 118 can rest over the rail for supporting the tray body 110 over the rail 120. Suitable fasteners, including adhesives, can fasten the tray body 110 to the rail 120.

Figure 5:
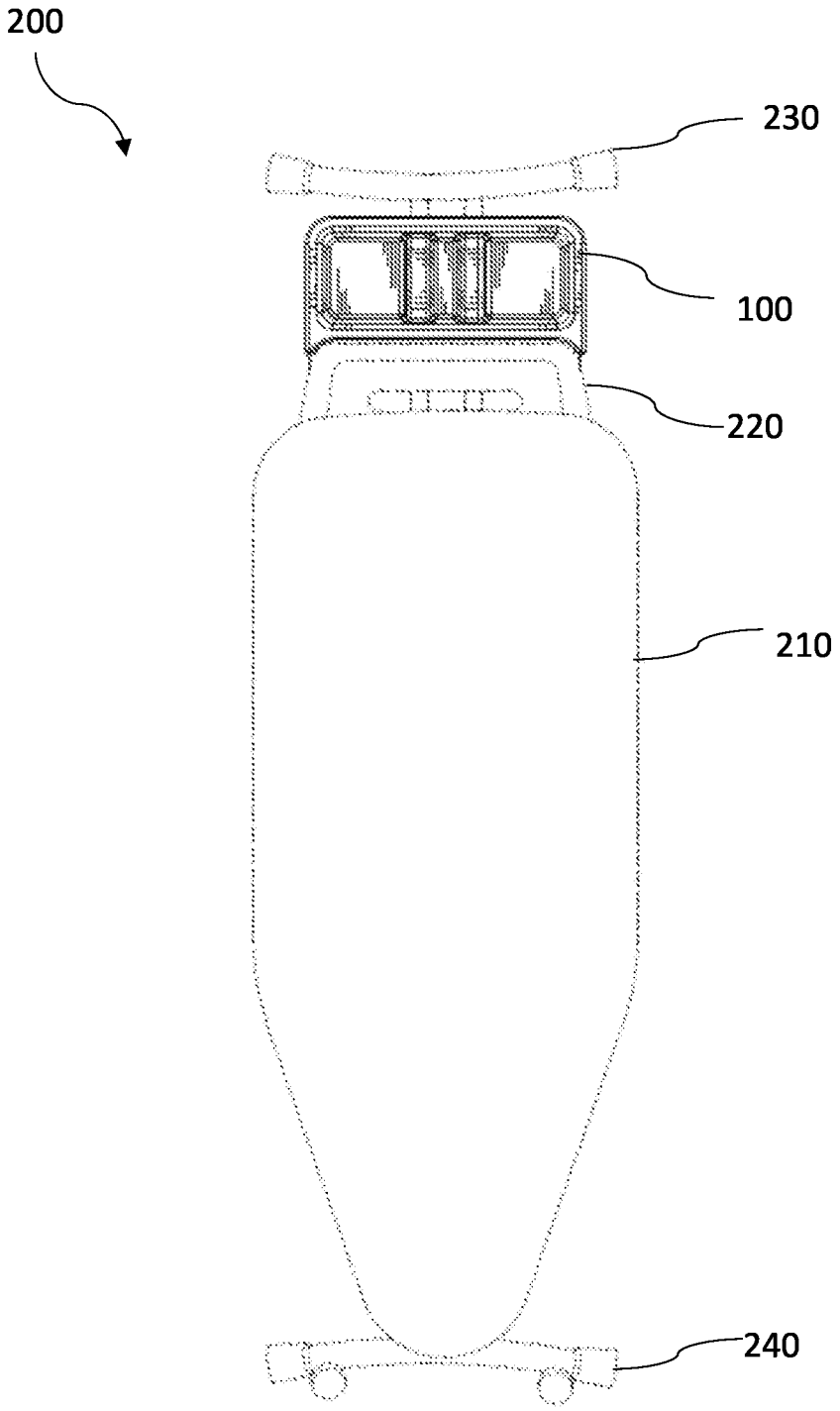
FIG. 5 shows a top view of an ironing board with the storage tray mounted at end of the board, according to an exemplary embodiment of the present invention.
Figure 6:
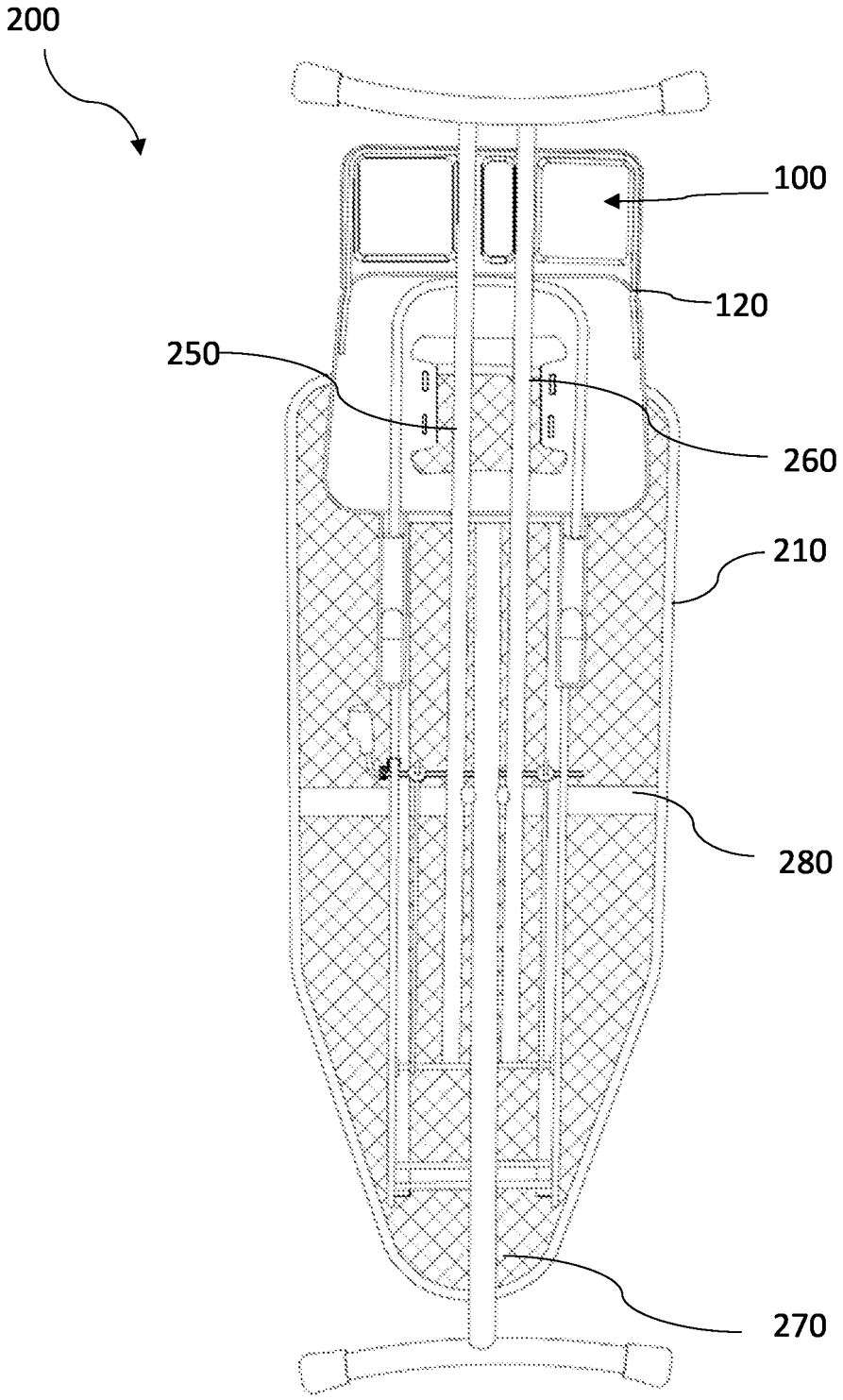
FIG. 6 is a bottom view of the ironing board in a folded state and two legs of a stand received in spaces between the three compartments of the storage tray, according to an exemplary embodiment of the present invention.

Referring to FIGS. 5 and 6, wherein the FIG. 5 shows a top view of a disclosed ironing board 200 and FIG. 6 shows the bottom view of the ironing board 200, the ironing board 200 is shown folded in both the FIG. 5 and FIG. 6. The ironing board 200 can have an elongated board 210, wherein a top surface of the elongated board 210 is the ironing surface. The elongated board 210 can have a broader side and a narrower side. Along the broader side of the elongated board 210, it can be seen an iron tray 220 that can be fastened to a frame 280 of the ironing board 200. This iron tray 220 can be used to put a hot iron during the ironing process. It is to be noted that the elongated board 210 and the iron tray 220 are known in the art. The iron tray 220, generally made of metal, can be welded to the metal frame 280 of the ironing board 200.

Frame 280 of the ironing board 200 can be seen in the bottom view shown in FIG. 6. The ironing board 200 can include two stands, i.e., a first stand 230 and a second stand 240, that are pivotally coupled to the frame 280. The two stands can be folded for storing the ironing board and the folded ironing board 200 can be unfolded to a standing position for use. FIG. 6 shows the two stands of the ironing board 200 in the folded state. The first stand 230 shown extending away from the iron tray 220 can have two legs, i.e., a first leg 250 and a second leg 260. The second stand 240 is shown to with a single leg 270. It is understood, however, that the second stand 240 can have more than one leg without departing from the scope of the present invention. Both the frame and the two stands are known in the art and the folding and unfolding of the two stands are also known. The rail 120 of the storage tray 100 can be fastened to the iron tray 220. The bottom of the iron tray 220 can have suitable fasteners for securing the two ends of the rail. Alternatively, the two ends of rail 120 can be welded to the iron tray 220. The space between the three compartments of the storage tray 100 can be such as to receive the two legs of the first stand. As shown in FIG. 6, the first leg is received between the first two compartments, and the second leg can be received between the second compartment and the third compartment, wherein the storage tray 100 does not interfere with the folding and unfolding of the two stands. The space between two adjacent compartments of the storage tray 100 can be proportional to the diameter or width of the first leg and the second leg. The spacings between the three compartments can be critical to accommodate the two legs of the first stand, and without the spacing, the compartments may not allow the ironing board 200 to fold completely. It is understood that the rails of the storage tray can be directly fastened to the frame of the ironing board, and the iron tray can be omitted, and the direct fastening of the storage tray to the frame of the ironing board is within the scope of the present invention.

In certain exemplary embodiments, the tray can include two compartments of a predetermined depth. The depth of the two compartments can be the same or different. Similarly, the length and width of the two compartments can be different. The space between two compartments can be such that a leg of the stand of the ironing board can be accommodated within the space between the two compartments when the stand is folded. It is understood that the stands having a single leg are known, and the tray can be designed to accommodate such single leg stands without departing from the scope of the present invention. Also, two or more compartments are within the scope of the present invention provided the one or two legs of the ironing board can be accommodated between two adjacent compartments.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A tray for an ironing board, the ironing board has two stands, a first stand of the two stands has a first leg and a second leg, the tray comprises:

a tray body, the tray body comprises three spaced apart compartments, a first compartment, a second compartment, and a third compartment, wherein a first spacing between the first compartment and the second compartment, and a second spacing between the second compartment and the third compartment, the first spacing and the second spacing are configured to receive the first leg and the second leg respectively, wherein the tray is configured to be mounted to a frame of the ironing board, such that the first leg is received within the first spacing and the second leg is received within the second spacing when the first stand is folded.

2. The tray according to claim 1, wherein the first compartment and the third compartment are bigger than the second compartment.

3. The tray according to claim 1, wherein the tray body further comprises a flange extending from a top periphery of the three spaced apart compartments, the tray further comprises a support rod having a first end and an opposite second end, wherein the support rod wraps around two short sides and one long side of the tray body and below the flange, wherein the first end and the second end of the support rod extends parallel to each other and away from the tray body.

4. The tray according to claim 3, wherein the first end and the second end are configured to be fastened to the frame of the ironing board.

5. The tray according to claim 1, wherein bottoms of the first compartment, the second compartment, and the third compartment are coplanar.

6. The tray according to claim 1, wherein a top rim of the tray body is continuous and planar.

7. The tray according to claim 1, wherein each of the first compartment, the second compartment, and the third compartment comprises a bottom and walls that extend upwards from the respective bottom to define an inner volume of each of the first compartment, the second compartment, and the third compartment.

8. The tray according to claim 7, wherein the first spacing is between adjascent walls of the first compartment and the second compartment, and the second spacing is between adjascent walls of the second compartment and the third compartment.

9. The tray according to claim 7, wherein adjascent walls of the first compartment and the second compartment and adjascent walls of the second compartment and the third compartment divides an inner volume of the tray body into the first compartment, the second compartment, and the third compartment.

10. The tray according to claim 1, wherein depths of the first compartment, the second compartment, and the third compartment from a top rim of the tray body are same.

11. An ironing board comprising:

a horizontal frame;

a first stand, the first stand has a first leg and a second leg;

a second stand, wherein the first stand and the second stand are pivotally coupled to the horizontal frame such that the first stand and the second stand can be folded and unfolded; and a tray comprising:

a tray body, the tray body comprises three spaced apart compartments, a first compartment, a second compartment, and a third compartment, wherein a first spacing between the first compartment and the second compartment, and a second spacing between the second compartment and the third compartment, the first spacing and the second spacing are larger than a width or a diameter of the first leg and the second respectively, wherein the tray is mounted to the horizontal frame, such that the first leg is received within the first spacing and the second leg is received within the second spacing when the first stand is folded.

12. The ironing board according to claim 11, wherein the first compartment and the third compartment are bigger than the second compartment.

13. The ironing board according to claim 11, wherein the tray body further comprises a flange extending from a top periphery of the three spaced apart compartments, the tray further comprises a support rod having a first end and an opposite second end, wherein the support rod wraps around two short sides and one long side of the tray body and below the flange, wherein the first end and the second end of the support rod extends parallel to each other and away from the tray body.

14. The ironing board according to claim 13, wherein the first end and the second end are fastened to the horizontal frame.

15. The ironing board according to claim 14, wherein the horizontal frame further comprises an ironing plate, and the first end and the second end of the support rod are fastened to the ironing plate.

16. The ironing board according to claim 11, wherein bottoms of the first compartment, the second compartment, and the third compartment are coplanar.

17. The ironing board according to claim 11, wherein a top rim of the tray body is continuous and planar.

18. The ironing board according to claim 11, wherein each of the first compartment, the second compartment, and the third compartment comprises a bottom and walls that extend upwards from the respective bottom to define an inner volume of each of the first compartment, the second compartment, and the third compartment.

19. The ironing board according to claim 18, wherein the first spacing is between adjascent walls of the first compartment and the second compartment, and the second spacing is between adjascent walls of the second compartment and the third compartment.

20. The ironing board according to claim 18, wherein adjascent walls of the first compartment and the second compartment and adjascent walls of the second compartment and the third compartment divides an inner volume of the tray body into the first compartment, the second compartment, and the third compartment.

* * * * *